United States Patent [19]

Clark

[11] 4,385,411

[45] May 31, 1983

[54] ANGLE BROOM

[75] Inventor: Frank Clark, Girard, Pa.

[73] Assignee: Tantera, Inc., Girard, Pa.

[21] Appl. No.: 263,103

[22] Filed: May 12, 1981

[51] Int. Cl.[3] ..... A46B 9/00; A46B 9/08

[52] U.S. Cl. ..... 15/160; 15/171

[58] Field of Search ..... 15/159 R, 159 A, 160, 15/168, 170, 191, 192, 193

[56] References Cited

U.S. PATENT DOCUMENTS 1,267,074 6/1918 Homan ..... 15/171

4,250,589 2/1981 Alvin ..... 15/193

*Primary Examiner*—Peter Feldman

*Attorney, Agent, or Firm*—Charles L. Lovercheck; Wayne L. Lovercheck; Dale R. Lovercheck

[57] ABSTRACT

A broom for sweeping floors and the like. The broom has a frame and a handle with straws fixed to one side of the frame and the handle fixed to the side of the frame remote from the straws. The straws terminating in a plane disposed at an acute angle to the handle so that the handle is disposed at an angle equal to the natural angle for sweeping the end of the straw thereby providing a convenient angle for sweeping without unevenly distorting the broom straws.

2 Claims, 4 Drawing Figures

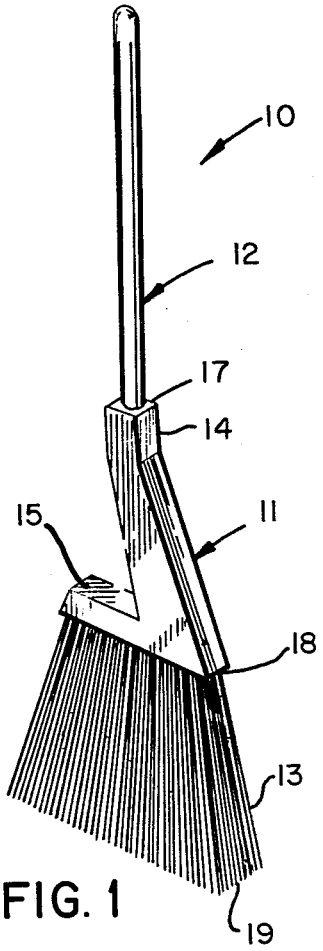
FIG. 1
FIG. 2
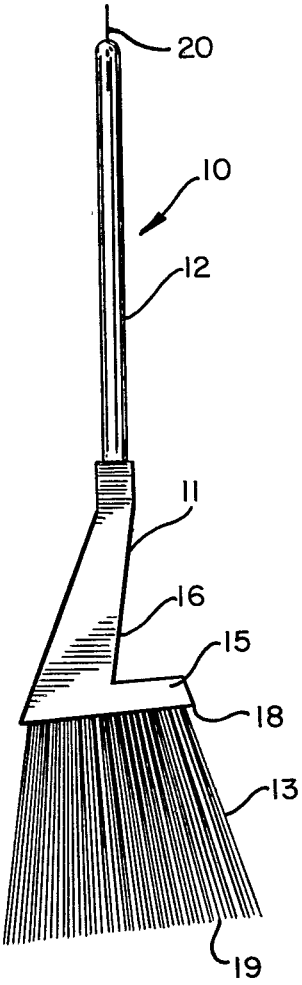
FIG. 3
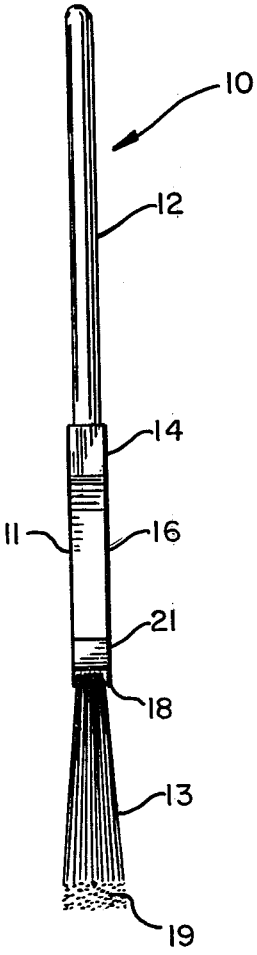
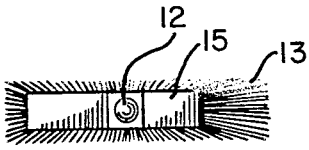
FIG. 4

ANGLE BROOM

STATEMENT OF INVENTION

The broom disclosed herein has a handle disposed at an angle of approximately 10° to the broom straws thereby providing a convenient angle for sweeping without unevenly distorting the straws. The frame is a rigid generally L-shaped frame with a handle at one end and the straw receiving part at the other.

REFERENCE TO PRIOR ART

The following patents shown various kinds of brushes with handles disposed at an angle to the bristles, but none of them show a broom for sweeping such as applicant's: U.S. Pat. Nos. 4,157,598, 3,994,037, 2,705,336 and 3,668,731.

OBJECTS OF THE INVENTION

It is an object of the invention to provide an improved broom for sweeping.

Another object of the invention is to provide a broom that is simple in construction, economical to manufacture and simple and efficient to use.

Another object of the invention is to provide a broom wherein the handle is disposed at an angle approximately 10° to the broom straws.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit of sacrificing any of the advantages of the invention.

GENERAL DESCRIPTION OF THE DRAWINGS

FIG. 1 is an isometric view of a broom according to the invention.

FIG. 2 is a side view of the broom shown in FIG. 1.

FIG. 3 is an edge view of the broom.

FIG. 4 is a top view of the broom.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWING

Now with more particular reference to the drawing, the broom according to the invention is shown generally at 10, having a frame 11 and a handle 12 received in a bore 17 in the upper end of the handle receiving part of the frame and fixed thereto. The frame 11 has a straw receiving part 15 fixed to the intermediate part 16 and extending upwardly from the longitudinal axis at approximately 60° thereto. The upper side of the straw receiving part 15 provides a convenient area for hanging the broom from a hanger in an inverted position. The straw receiving part 15 having the upper ends of straws 13 fixed to it and received in it at 21 in a conventional manner. The said lower end 18 of said straw receiving part being disposed generally in a plane. The straw receiving part has a lower edge 18 and the lower edge has attached to it said straws. The straws each terminate at their lower ends remote from the handle in a plane disposed approximately 10° to the axis of the handle. The angle is such that a person holding the broom handle in a natural sweeping position will have the plane 19 of the lower end of the straws all engage the floor with substantially the same pressure.

With an ordinary broom, the straws adjacent the person using the broom are distorted more than the other straws.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A broom having a integral, one piece frame (11), a handle (12) and straws (13), said frame (11) comprising a handle receiving part (14), a straw receiving part (15) and an intermediate part (16), said handle receiving part (14) having a handle receiving opening (17) therein receiving an end of said handle (12), said straw receiving part (15) having a lower side (18) disposed in a first plane, the upper ends of said straws (13) being received in the said lower side (18) of said straw receiving part and attached thereto, said straws (13) each terminating at their lower ends remote from said handle in ends in a second plane (19) generally parallel to said first plane, said handle having a longitudinal axis (20) disposed at an acute angle of approximately 10° to said second plane (19) which is approximately equal to the natural angle to a floor that a person holds a broom while sweeping, said straw receiving part (15) having an upper side extending generally parallel to said lower side (18) of said straw receiving part, said intermediate part being integrally fixed to said handle receiving part and to said lower straw receiving part and extending upwardly from the longitudinal axis at an angle of approximately 60° to the upper side of said lower straw receiving part, said upper side of said straw receiving part providing a convenient area for engaging a hanger for hanging said broom in an inverted position.

2. The broom recited in claim 1 wherein said frame is generally plate-like and has two generally flat parallel sides.

* * * * *